United States Patent [19]

Hanula et al.

[11] Patent Number: 4,645,085

[45] Date of Patent: Feb. 24, 1987

[54] METHOD OF ENHANCING RIGIDITY IN A RAILWAY CAR COUPLER KNUCKLE

[75] Inventors: Richard M. Hanula, Lyndhurst; Fred C. Kulieke, Jr., Tallmadge, both of Ohio

[73] Assignee: National Castings, Inc., Cicero, Ill.

[21] Appl. No.: 720,797

[22] Filed: Apr. 8, 1985

[51] Int. Cl.[4] ..... B61G 3/00

[52] U.S. Cl. ..... 213/155; 213/152

[58] Field of Search ..... 213/109, 113, 114, 151, 213/152, 155

[56] References Cited

U.S. PATENT DOCUMENTS

| | | | |
|---|---|---|---|
| 1,897,279 | 2/1933 | Richards | 213/126 |
| 3,856,156 | 12/1974 | Metzger | 213/151 |
| 3,972,421 | 8/1976 | DePenti | 213/127 |
| 4,090,615 | 5/1978 | Martin | 213/151 |
| 4,206,849 | 6/1980 | Kaim | 213/151 |

FOREIGN PATENT DOCUMENTS

| | | | |
|---|---|---|---|
| 540837 | 5/1957 | Canada | 213/155 |
| 663607 | 12/1951 | United Kingdom | 213/152 |

*Primary Examiner*—Randolph A. Reese

[57] ABSTRACT

A railway car coupler knuckle includes integral nose, hub, and tail portions. The tail portion has a lock shelf and an associated locking face as well as pulling lugs associated therewith. A tail core support aperture in the tail portion communicates with internal tail portion coring extending from a free end of the tail portion toward coring in the hub portion. The core support aperture and tail portion coring have been strategically relocated and reconfigured to reduce stresses imposed at critical areas during loading of the knuckle pulling lugs and locking face to thereby increase the resistance of the tail portion to fatigue failures.

4 Claims, 7 Drawing Figures

METHOD OF ENHANCING RIGIDITY IN A RAILWAY CAR COUPLER KNUCKLE

BACKGROUND OF THE INVENTION

This invention generally pertains to railroad car couplers. More specifically, the present invention relates to the tail portion of a coupler knuckle wherein the internal coring has been relocated and/or reconfigured to reduce stresses imposed thereon during use.

The invention is particularly applicable to standard Association of American Railroads (AAR) type E and type F or other knuckle type couplers which are comprised of a coupler head having a vertical lock chamber and a pivotally connected coupler knuckle. However, it will be appreciated by those skilled in the art that the invention has broader applications and may also be adapted to use in other types of railway couplers.

Heretofore, standard type E and type F railway coupler knuckles have been internally cored and have included a core support aperture extending through a surface of the knuckle tail portion. Since the knuckles are frequently carried manually by maintenance personnel for service replacement and the like, they require internal coring for maintaining their weight, approximately 84 pounds at present, within acceptable limits. As can be appreciated, this weight is quite substantial and cannot be increased by much before a knuckle becomes too heavy to be carried and manipulated manually.

Since each knuckle is cored, an aperture located in the tail portion rear wall is required for supporting a core member externally of the knuckle to assure proper placement thereof during the casting process. This aperture also is required to facilitate proper cleaning of the casting sand from the knuckle. Finally, conventional foundry practice advises against having a solid tail portion since such a construction would be more likely to develop internal voids which may weaken the knuckle. This situation is particularly troublesome when the voids approach the knuckle surface in critical areas thereof.

The conventional coupler knuckle construction which is provided with a core support aperture in the rear surface of the tail portion has been found to have certain disadvantages. There is a certain amount of preliminary wearing off of high spots and surface roughness on all bearing surfaces when a coupler initially is placed into service and during the time when the coupler components are becoming seated in place. This seating in place is accompanied by an opening or stretching of the coupler contours. The conventional locations of the tail core support aperture and tail core allow undesired deformation at either one or both of upper and lower pulling lugs during loading which occurs in normal coupler use. Such deformation places a major portion of the coupler pulling forces on the tail portion locking face and causes high localized stresses to be exerted at critical locations. These stresses, in turn, lead to premature fatigue failure of the knuckle.

It has, therefore, been considered desirable to develop an improved coupler knuckle wherein the tail core support aperture and tail core would be repositioned and/or reconfigured to enhance knuckle reliability and service life while retaining the benefits and advantages provided by coring. The subject invention is deemed to overcome the foregoing difficulties and others, and meet the above stated needs while providing better and more advantageous overall results.

BRIEF SUMMARY OF THE INVENTION

In accordance with the present invention, a new and improved cored coupler knuckle is provided for a railway car coupler assembly.

More particularly in accordance with the invention, the coupler knuckle includes integral nose, hub, and tail portions. A hollow core extends through the tail portion from adjacent a terminal end thereof toward the hub portion, and a core support aperture penetrates an end wall of the tail portion at the terminal end into communication with the core. A first pulling lug on the tail portion is spaced from the terminal end and has a first pulling surface adapted to have a pulling force applied against a section thereof from a first end toward a second end. A locking face extends generally between the first pulling surface and the tail portion end wall at the pulling surface first end. The core support aperture penetrates the tail portion end wall at an area thereof spaced from the locking face so that a major portion of the aperture is spaced remote from that section of the first pulling surface which is adapted to receive a pulling force. In this manner, the tail portion has greater rigidity when pulling forces are applied against the first pulling surface.

In accordance with another aspect of the invention, that portion of the tail portion core disposed intermediate the end wall and the first pulling surface has a major portion thereof spaced remote from that section of the first pulling surface which is adapted to receive a pulling force.

According to a further aspect of the invention, a second pulling lug is included on the tail portion generally opposite from the first pulling lug. This second pulling lug has a second pulling face which is adapted to receive a pulling force from a first end toward a second end thereof. At least a major portion of the core support aperture and the tail portion core disposed intermediate the end wall and the second pulling surface is spaced remote from that portion of the second pulling surface which is adapted to receive a pulling force.

According to still another aspect of the invention, the first and second pulling lugs are spaced apart from each other and extend outwardly from opposite surfaces of the tail portion. The core in the tail portion is configured so that at least a major portion thereof is disposed intermediate the first and second lugs without penetration thereinto between the end wall and the first and second pulling surfaces.

According to a further aspect of the invention, the coupler knuckle is particularly adapted to use on AAR type E or type F or other knuckle type couplers.

In accordance with yet another aspect of the invention, a method for strengthening a cored coupler knuckle against fatigue failure is advantageously provided.

The principal advantage of the present invention is the provision of a new coupler knuckle which is internally cored in a manner which reduces stress at critical locations.

Another advantage of the invention is the provision of a coupler knuckle which reduces fatigue failures at the area of a pulling lug.

Still another advantage of the invention resides in an improved coupler knuckle that increases the strength of the cored casting to minimize the possibility of breakage during knuckle manufacture.

A further advantage of the invention is in the provision of an improved knuckle which has substantially similar weight characteristics as prior conventional knuckles while providing greater strength and reliability properties therefor.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
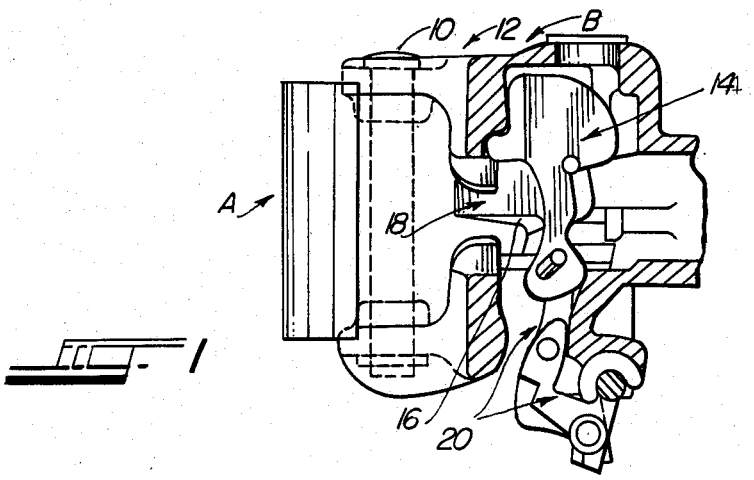
FIG. 1 is a side elevational view in partial cross-section of a railway car coupler with the coupler lock being shown in an unlocked position as the knuckle is in the initial stages of movement toward its open position.

Referring now to the drawings, wherein the showings are for purposes of illustrating a preferred embodiment of the invention only and not for purposes of limiting same, FIG. 1 shows a coupler assembly including a knuckle A operatively mounted in a coupler B. Knuckle A as generally shown in FIG. 1 is the type used in an Association of American Railroads (AAR) type F coupler. It should, however, be appreciated that the knuckle of an AAR type E coupler is essentially identical so that the subject invention is equally applicable thereto. While the improved knuckle is primarily designed for either a type E or type F coupler, it will be appreciated that the overall inventive concept involved could be adapted to use in other coupling environments as well.

Continuing with reference to FIG. 1, knuckle A is pivotally connected by a pin 10 to a head 12 of coupler B. The knuckle is shown in the initial stages of movement from a closed position toward an open position. To permit this movement, a lock construction 14 is pivoted from a seated, locking position on a lock shelf 16 of a knuckle tail portion 18. Lock 14 is actuated in a conventional, known manner by means of a linkage generally designated by the numeral 20. Since this linkage and its operation are known, and since they form no part of the present invention, they are not discussed in detail herein.

Figure 2:
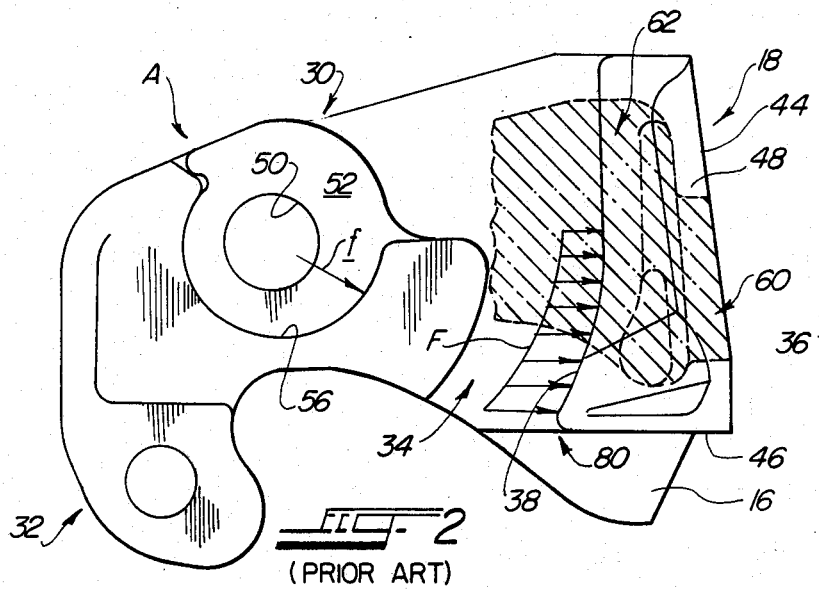
FIG. 2 (PRIOR ART)
FIG. 2 is an enlarged plan view of a knuckle formed according to the prior art.
Figure 3:
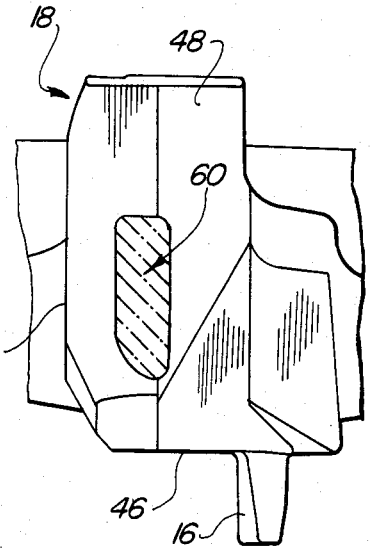
FIG. 3 (PRIOR ART)
FIG. 3 is an end view of the prior art knuckle shown in FIG. 2.
Figure 4:
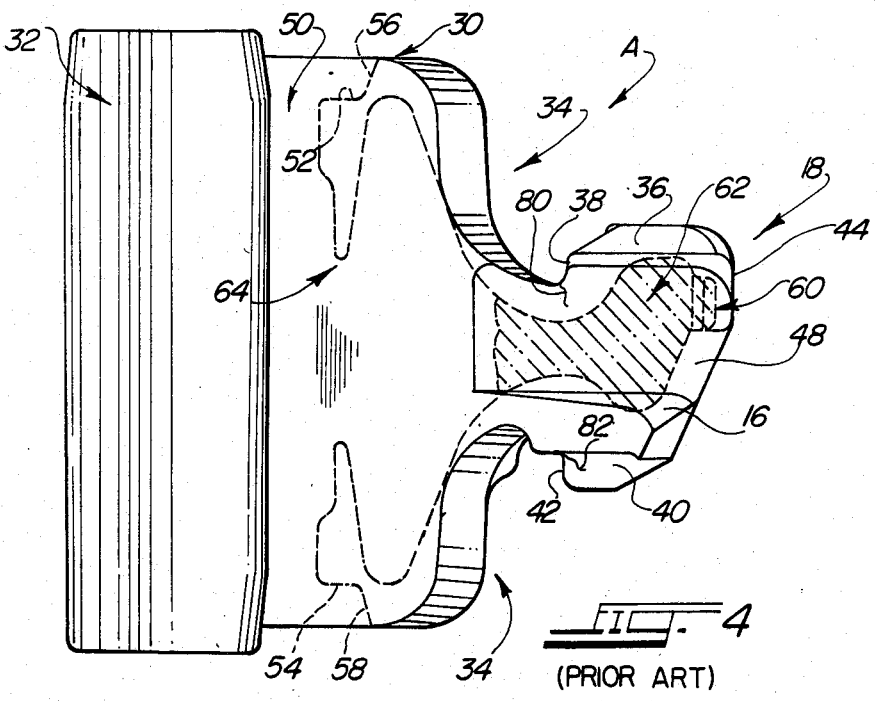
FIG. 4 (PRIOR ART)
FIG. 4 is a side elevational view of the prior art knuckle shown in FIG. 2.

With reference to FIGS. 2, 3, and 4, the prior art knuckle shown is of the type employed in an AAR type F coupler assembly. As conventionally produced, the knuckle is cast to include tail portion 18, a hub portion 30, and a nose portion 32 integral with each other. Opposed throat areas 34 taper inwardly toward each other from the hub portion toward the tail portion.

Tail portion 18 includes an upper pulling lug 36 having a forward pulling surface 38, and a lower pulling lug 40 having a forward pulling surface 42, and an outer or rear surface 44 defining a terminal end. A planar locking face 46 communicates between upper and lower pulling legs 36, 40 and rear surface 44, and locking shelf 16 extends outwardly of the locking face in a generally normal relationship thereto. An end wall 48 is disposed adjacent to rear surface 44.

Hub portion 30 includes a pivot pin hole 50 extending between the upper and lower surfaces thereof, and is adapted to receive pivot pin 10 for pivotally mounting the knuckle in an associated coupler B as shown in FIG. 1. Hole 50 includes recessed areas 52, 54 at the opposed ends thereof, and these recessed areas are surrounded at a portion of the outer boundaries thereof by rims 56, 58.

Because knuckle A comprises a steel casting, and because of its rather large size, a solid knuckle would be very difficult to carry any distance and/or manipulate by hand. Carrying some distance and/or manipulation may be required, for example, in the event of knuckle failure in the field where maintenance or service personnel must then transport a new knuckle to the rail car for installation. Moreover, it has been found that a solid knuckle would be more likely to develop internal voids which may weaken the structure. Such a situation is particularly troublesome when these voids approach the knuckle surface in critical areas thereof. Since accessibility to rail cars for purposes of repairing damaged or broken knuckles is oftentimes very difficult, it is highly desirable to provide a knuckle construction wherein inherent problems in the manufacturing process would be eliminated.

To that end, knuckles of the type here under discussion have been cored, i.e., hollowed out, in what previously were considered to be non-critical areas thereof. Such coring occurred in the area of the knuckle between tail portion 18 and hub portion 30, and between hub portion 30 and nose portion 32. As a result of coring, prior knuckles of this type have weighed approximately 84 pounds and were considered to be manageable for carrying and/or manipulation. Only the coring utilized in the tail portion is of interest to the subject invention, and the following description will, therefore, be limited thereto.

Specifically, and with continued reference to FIGS. 2, 3, and 4, a core support aperture 60 penetrates rear surface 44 into communication with a tail portion core 62. Rear surface 44 and the rear area of core portion 62 form end wall 48 containing aperture 60. As shown in FIG. 4, this tail core extends to and communicates with a hub portion core 64. In the casting process, a tail portion core member (not shown) is supported at one end by the mold or other means and communicates at the other end with a hub core member (not shown). Thus, when the knuckle is cast, core support aperture 60 is formed in the knuckle tail portion along with core 62. A core member also communicates between hub core 64 and knuckle nose portion 32; however, since this core member and the relationship thereof to the knuckle forms no part of the present invention, it is neither shown in the drawings nor described in detail herein. The core members themselves are constructed from materials and in a manner commensurate with casting practice such that following the cast, the core material may be emptied from the interior of the casting as at, for example, pivot pin hole 50 and core support aperture 60.

The length of the conventional core support aperture 60 is approximately 2.75 inches (FIG. 3). On the inside of end wall 48, portions of the tail core expand in both width (FIG. 2) and thickness (FIG. 4). At its closest point as shown in FIG. 2, tail core 62 is approximately 0.75 inches away from locking face 46. As shown in FIG. 4, portions of tail core 62 also penetrate into upper and lower pulling lugs 36, 40. This creates a rather large cavity within tail portion 18 which can have serious destructive effects as will be described. It is the location and conformation of core support aperture 60 and tail core 62 as cross-hatched in the Figures which permit premature and/or undesired cracks or breakage to occur. The subject invention is directed to providing a successful solution to these problems.

In use, with coupler knuckle A in a pull condition relative to the knuckle of an adjacent rail car, the primary pull force is exerted against upper and lower pulling surfaces 38, 42 through cooperation with corresponding upper and lower pulling surfaces on coupler B as is conventional. In some instances, due to misalignment, tolerance variations, and the like, one of surfaces 38, 42 may experience a greater portion of the pulling force. In addition, rims 56, 58 of hub portion recesses 52, 54 are also designed to take some pulling force from matingly received portions of the coupler head so that no tension force is exerted against the pivot pin. The force component exerted on the hub portion is shown by arrow f in FIG. 2. The direction of this component causes the lock on the coupler and locking face 46 to be moved into forced engagement with each other.

In FIG. 2, pull force F against pulling surface 38 is shown by a plurality of spaced apart arrows. The length and direction of the arrows indicate the pull load, and it will be noted that this pull load is greater at the area of pull surface 38 adjacent locking face 46. As the pull load is applied to areas of the pulling surface spaced further from the locking face, the pull force decreases in magnitude. It will be appreciated that a similar force distribution will occur at lower pulling surface 42, however, that force diagram has not been shown for convenience purposes. The reason for the difference in loading along surfaces 38, 42 is due to the lack of rigidity in knuckle tail portion 18. This lack of rigidity is occasioned by the configuration and location of core support aperture 60 and tail core 62.

In particular, the core support aperture is directly opposite a significant portion of that section of pulling surface 38 which is under load (FIG. 2). In like manner, the somewhat bulbous areas of tail core 62 extend into both of upper and lower pulling lugs 36, 40 (FIG. 4), and this configuration reduces the overall strength at these areas. That is, when the knuckle is under load, pulling surfaces 38, 42 are caused to deform slightly, and such deformation transfers the applied force to areas of greater rigidity. Thus, the pull load or force F is greater along pulling surfaces 38, 42 adjacent locking face 46. Moreover, the pull force F shown in FIG. 2 for pulling surface 38 is under optimum conditions where both surfaces 38 and 42 are sharing the pull force proportionately. Quite often, again, due to misalignment, tolerance variations, and the like, the knuckle is not placed under optimum pulling conditions so that the pull load distribution is even more greatly concentrated adjacent locking face 46.

The pulling forces applied to any one coupler knuckle are, of course cyclical as a function of the manner of rail car movement along the associated track as well as a number of other factors. The cyclical application or alteration of the pulling force causes pull load F to increase or decrease. This, in turn, causes stresses within the knuckle, and there is a particular stress concentration at the area where the pull load is the greatest, ie., adjacent locking face 46. Because the stress is concentrated at a particular area of the knuckle, and since the stresses are often above acceptable limits for the steel which is conventionally used in cast knuckles, the knuckle will experience fatigue failure in tail portion 18 after some period of time.

Such failure most often takes the form of a crack at area 80 which generally comprises the area of intersection of the lowermost portion of pulling surface 38 with locking face 46. However, it is also possible, depending upon loading of the tail portion, that fatigue failure could occur at area 82 (FIG. 4) in lower pulling lug 40. The fatigue failure cracks which generally occur at area 80 begin small and then progressively increase in magnitude during further knuckle service. It is, therefore, necessary to replace the knuckle when fatigue cracks begin to occur. Unfortunately, detection of the cracks or complete knuckle failure may occur where it is difficult to replace the knuckle in situ or remove the car from further service until a repair has been made.

Figure 6:
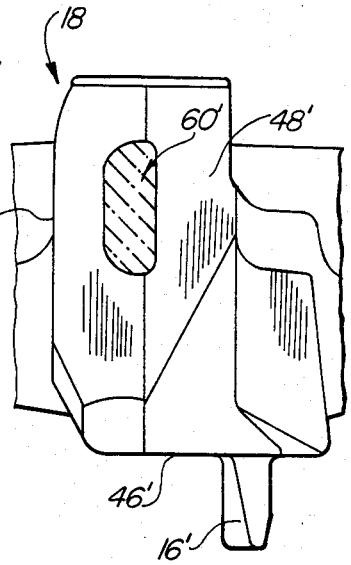
FIG. 6 is a view similar to FIG. 3 showing the subject improved knuckle; and, FIG. 7 is a view similar to FIG. 4 showing the subject improved knuckle.
Figure 7:
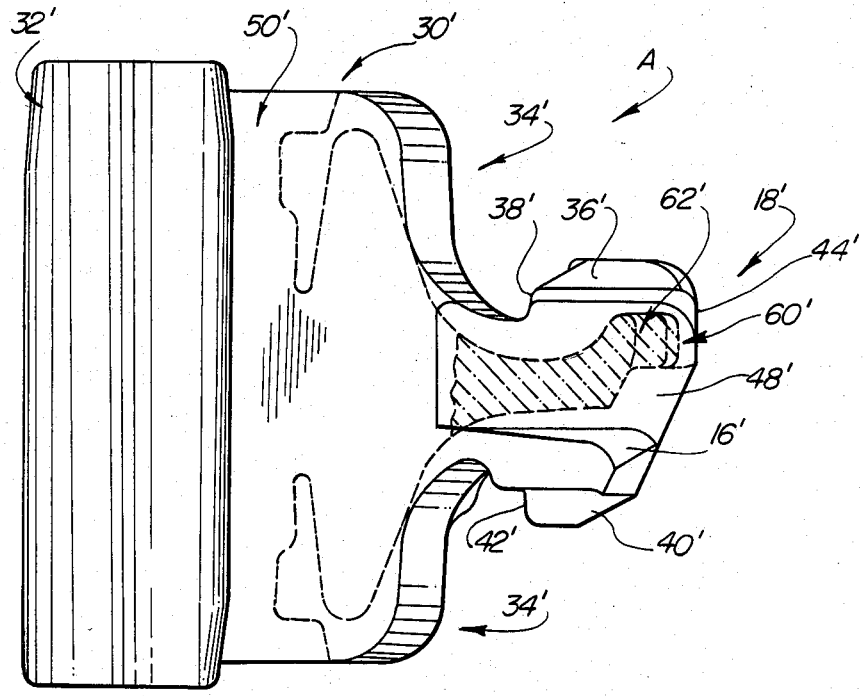

The present invention overcomes the foregoing problems and provides a coupler knuckle which is designed to eliminate fatigue failures of the type described while retaining the knuckle coring and without significantly increasing the knuckle weight. In this regard, the invention will hereinafter be described with reference to FIGS. 5, 6, and 7. For ease of illustration and appreciation of the invention, like components are identified by like numerals with a primed (') suffix and new components are identified by new numerals. As will be seen from a comparison with the conventional knuckle shown in FIGS. 2–4, the subject new design involves a significant relocation of core support aperture 60' and a significant reconfiguration of a portion of tail core 62'. Except for those portions shown in FIGS. 5–7 which have been modified, the remainder of the tail core remains identical to that which has been used previously.

First, core support aperture 60' has been shifted along end wall 48' away from locking face 46', and tail core 62' has similarly been shifted so that a greater mass of metal is interposed between the core and locking face 46'. Indeed, the aperture has now been moved to a distance of approximately 3.0 inches from locking face 46' (FIG. 6). Also, and within the area of the tail portion between upper and lower pulling lugs 36', 40', tail core 62' has been moved to a position approximately 1.75 inches away from the locking face (FIG. 5) at its closest location. Another significant modification contemplated by the subject invention is found in redesigning the conformation of the tail core so as to eliminate the bulbous areas penetrating upper and lower pulling lugs 36', 40'. A comparison should be made, for example, between the tail core conformations of FIGS. 4 and 7. The improvement provided by the subject invention effectively shifts the solid mass of the tail portion toward locking face 46', and toward pulling lugs 36', 40', particularly at and adjacent pulling surfaces 38', 42', respectively.

Figure 5:
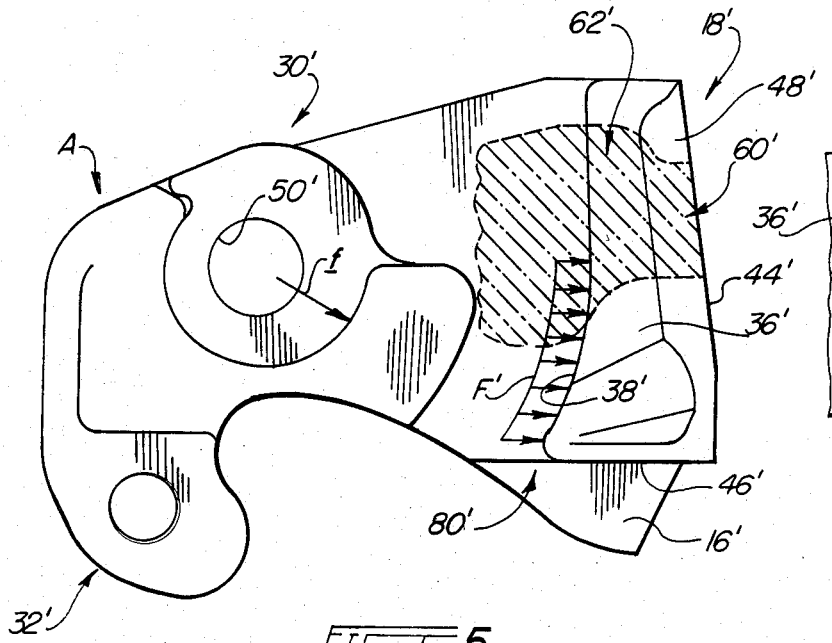
FIG. 5 is an enlarged plan view similar to FIG. 2 showing the subject improved knuckle.

The pull load F' is included on FIG. 5 for the subject new design. As will be noted, it is substantially constant over the entire length thereof. This represents a significant improvement over the unequal pull load distribution hereinabove described with reference to the prior art. The reason that a more uniform pull load distribution trend is experienced with the subject design is due to the fact that there is greater rigidity across the span of pull surfaces 38', 42' which experience loading. Likewise, the pulling lugs 36' and 40' adjacent locking face 46' are increased in cross-section or rigidity in all directions, so that even if pull bearing loads are somewhat concentrated toward the locking face, they better resist combined loadings from locking face and pulling lug surfaces to reduce stress at the critical location on knuckle tail 18'. Again, this rigidity has been achieved by effectively moving or shifting the solid area of the knuckle tail portion toward locking face 46' and into pulling lugs 36', 40'. Thus, and while the improved knuckle may still experience some deformation at the tail portion, such deformation is significantly reduced so that the pull force loading remains more uniform.

Since concentration of the pulling forces adjacent locking face 46' at the junction of pulling lugs 36' and 40' with knuckle tail 18'have been reduced, the stress levels exerted on forward pulling surfaces 38', 42'are also reduced, i.e., maintained within level which will not adversely affect the knuckle in the way of fatigue failure. This result provides significantly improved capabilities for the knuckle and eliminates replacement problems which have heretofore been present in prior, conventional knuckle designs. Also, the new design has a tail core conformation which can be more readily formed without core damage during manufacture due to the presence of increased strength characteristics at a necked down section of the core adjacent core support aperture 60'.

The subject invention provides an improved coupler knuckle tail portion which has been strengthened to decrease the risk of fatigue failure which is common in prior, conventional coupler knuckles of this general type. This advantageous result has been realized by shifting the heavy section of the coupler knuckle tail portion toward the locking face and pulling lug pulling surfaces where it is needed, and moving the core support aperture away from the critical loaded area near the locking face. As previously noted, the subject improvement is particularly adapted for use in knuckles for AAR type E and F and other knuckle type couplers, although the broad concept thereof has application to other coupler types and designs.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A method for enhancing rigidity in a rail car coupler knuckle having integrally formed nose, hub, and tail portions and wherein at least said tail portion must be cored from the terminal end thereof toward said hub portion to form a hollow core for reducing the coupler weight toward a predetermined acceptable level, said tail portion including at least a first pulling lug defining a pulling surface generally laterally spaced from the end face of said terminal end and adapted to receive a pulling force over a section thereof from a first end at a locking face toward a second end spaced therefrom, and wherein said locking face is adapted to receive a component of the pulling force, said method comprising the steps of:

(a) determining the length of said pulling surface from said first end to said second end along which a pulling force will be operative when the knuckle is placed into use;

(b) locating a core support aperture in the end face of said terminal end spaced from said locking face and in communication with said tail portion core in such manner that at least a major portion of said aperture is spaced remote from that section of said pulling surface which is adapted to receive a pulling force; and, (c) configuring that portion of said hollow core in that portion of said tail portion intermediate said end face and said pulling surface so that at least a major portion thereof is spaced remote from that section of said pulling surface which is adapted to receive a pulling force.

2. The method as defined in claim 1 further including the step of shaping said core so that at least a major portion thereof between said end face and pulling surface is in a non-penetrating relationship with said pulling lug.

3. The method as defined in claim 2 wherein said knuckle tail portion includes a second pulling lug having a second pulling surface disposed on an opposite surface of said tail portion from said first pulling lug and first pulling surface, and further including repeating the steps of determining, locating, and configuring relative to both of said first and second pulling lugs and pulling surfaces.

4. The method as defined in claim 1 wherein said knuckle tail portion includes a second pulling lug having a second pulling surface disposed on an opposite surface of said tail portion from said first pulling lug and first pulling surface, and further including repeating the steps of determining, locating, and configuring relative to both of said first and second pulling lugs and pulling surfaces.

* * * * *